US008686868B2

(12) United States Patent
Stocker et al.

(10) Patent No.: US 8,686,868 B2
(45) Date of Patent: Apr. 1, 2014

(54) CONTAINER HANDLER ALIGNMENT SYSTEM AND METHOD

(75) Inventors: David G. Stocker, Roanoke, VA (US); Michael G. Bartel, Roanoke, VA (US); Gregory A. Hedrick, Christiansburg, VA (US)

(73) Assignee: TMEIC Corporation, Roanoke, VA (US)

( * ) Notice: Subject to any disclaimer, the term of this patent is extended or adjusted under 35 U.S.C. 154(b) by 0 days.

(21) Appl. No.: 13/575,967

(22) PCT Filed: Apr. 9, 2012

(86) PCT No.: PCT/US2012/032684

§ 371 (c)(1),
(2), (4) Date: Jul. 30, 2012

(87) PCT Pub. No.: WO2012/141987

PCT Pub. Date: Oct. 18, 2012

(65) Prior Publication Data

US 2013/0147640 A1 Jun. 13, 2013

Related U.S. Application Data

(60) Provisional application No. 61/474,982, filed on Apr. 13, 2011.

(51) Int. Cl.
*G08B 21/00* (2006.01)

(52) U.S. Cl.
USPC ..... 340/685; 340/673; 340/686.1

(58) Field of Classification Search
USPC ..... 340/572.1, 673, 679, 685, 686.1, 689, 340/686.6, 5.61, 10.1; 212/312, 316; 414/140.3, 141.3
See application file for complete search history.

(56) References Cited

U.S. PATENT DOCUMENTS

| | | | | |
|---|---|---|---|---|
| 4,858,775 | A * | 8/1989 | Crouch | 212/312 |
| 5,661,465 | A | 8/1997 | Hung et al. | |
| 5,765,981 | A * | 6/1998 | Huang et al. | 414/140.3 |
| 7,123,132 | B2 | 10/2006 | Heidenback et al. | |
| 7,916,026 | B2 * | 3/2011 | Johnson et al. | 340/572.1 |
| 2011/0148589 | A1 * | 6/2011 | Johnson et al. | 340/10.1 |

FOREIGN PATENT DOCUMENTS

| | | | |
|---|---|---|---|
| CN | 201198441 | Y | 2/2009 |
| DE | 3606363 | C2 | 4/1995 |
| EP | 1964806 | A1 | 9/2008 |
| JP | 8101008 | A | 4/1996 |

OTHER PUBLICATIONS

International Application No. PCT/US12/032684, International Search Report, Jun. 26, 2012.
International Application No. PCT/US12/032684, International Preliminary Report on Patentability, Oct. 15, 2013, 6 pages.
International Application No. PCT/US2012/032684, Written Opinion of the International Searching Authority, dated Jun. 26, 2012, 5 pages.
Co-Pending Application No. KP 10-2012-7030340, First Office Action Translation, dated Dec. 30, 2013, 2 pages.
Co-Pending Application No. KP 10-2012-7030340, First Office Action, dated Dec. 30, 2013, 4 pages.

* cited by examiner

*Primary Examiner* — Van T. Trieu
(74) *Attorney, Agent, or Firm* — New River Valley IP Law, PC; Michele L. Mayberry

(57) ABSTRACT

A system and method for assisting drivers of Bomb Carts and Shuttle Carriers to position their vehicles appropriately for loading and unloading containers at a gantry crane. The system uses laser scanners mounted at various levels on the gantry crane sill beams to determine the type, position, orientation and skew angle of the vehicles as well as whether the vehicles are in a loaded or unloaded condition. In addition, the system provides indicator devices to direct drivers how to move their vehicles.

10 Claims, 4 Drawing Sheets

CONTAINER HANDLER ALIGNMENT SYSTEM AND METHOD

CROSS-REFERENCES TO RELATED APPLICATIONS

This application claims priority from U.S. provisional application 61/474,982 which was filed on Apr. 13, 2011, and which is incorporated herein by reference in its entirety.

TECHNICAL FIELD

The subject invention relates generally to a simplified apparatus and method for the alignment of container handling equipment, such as Bomb Carts and Shuttle Carriers, with container handling cranes. More specifically, the disclosed system improves the efficiency of container pick-up or drop-off under a Container Crane.

BACKGROUND OF THE INVENTION

Various methods for alignment of container handling equipment with container handling cranes have been developed and deployed within the industry. However, such methods have been both costly and complex due both to the minimum number of laser scanners required to meet the required functions and the need for dynamic laser positioning hardware and software. The instant invention addresses both of these issues by reducing the number of lasers required and providing lasers which can remain in fixed orientations.

For the purposes of this disclosure, the following definitions apply:

"Container" refers to a shipping container, defined by ISO standard, used in international transport. Standard lengths include 20, 40 and 45 feet.

"Container Crane" and "Container Handling Crane" are terms referring to gantry cranes used to move ISO standard shipping containers, e.g., where containers are transferred from ship to shore at a port, or where containers are transferred from trucks at a container terminal.

"Bomb Cart" refers to a truck chassis (trailer) designed and manufactured for the purpose of transferring standard shipping containers in a container terminal.

"Shuttle Carriers" refers to rubber-Tired Gantry Cranes that are used to move containers within a container terminal. These may also be referred to as "Straddle Carriers", "Shuttle Trucks" and "Sprinters".

"Laser Scanners" refers to LIDAR ("laser radar") type sensors which provide a series of discrete distance measurements of angle and distance over a continuous rotational scan profile. Preferably, four SICK LMS type laser scanners are used in this application.

SUMMARY OF THE INVENTION

The present invention relates to a system and method for assisting drivers of Bomb Carts and Shuttle Carrier vehicles in positioning their vehicles, whether loaded or unloaded with containers, beneath a gantry crane in an acceptable position for further loading and/or unloading of containers. The crane has a landside sill beam mounted on a landside rail and a waterside sill beam mounted on a waterside rail. Each sill beam has an interior side facing the interior side of the opposing sill beam and an exterior side facing away from the opposing sill beam. The acceptable position is one in which the center of the side of the vehicle closest to either sill beam is less than a predetermined, known distance away from the center line of the crane represented by a line drawn from the center of the waterside sill beam through the center of the landside sill beam and the vehicle is skewed less than a predetermined, known amount, skew being the angle, if any, formed between a line drawn parallel to either sill beam and a line drawn parallel to the longitudinal centerline of the vehicle. At least one first laser scanner is attached to the exterior side of the landside sill beam, and at least one first laser scanner is attached to the interior side of the landside sill beam. At least one first target, each of which has a known shape and dimensions, is attached to each side of each vehicle. The first laser scanners function to detect the presence, location and orientation of any loaded or unloaded vehicle entering within the range of said first laser scanners as the result of reflection by the first targets of emissions from the first laser scanners. At least one second laser scanner is attached to both the exterior and interior sides of the landside beam. At least one second target, each of which has a known shape and dimensions, is attached to each side of each container. The second laser scanners function to detect the presence, location and orientation of containers loaded on to a vehicle entering within the range of said second laser scanner. At least one direction indicator is attached to each of the exterior side and the interior side of the landside sill beam for indicating to vehicle drivers whether their vehicle is properly positioned or needs to be moved forward or backward and whether their vehicle orientation is skewed in excess of a predetermined acceptable amount and needs to be repositioned. A computer is connected to the crane as well as to each first laser scanner, to each second laser scanner and to each direction indicator. The computer receives scanning data from the first laser scanners and the second laser scanners in order to calculate the location and orientation of any vehicle within the range of the first laser scanners and the location and orientation of any container loaded on a vehicle within the range of the second laser scanners and, further, for activating the direction indicators.

BRIEF DESCRIPTION OF THE DRAWINGS

The foregoing and other objects, aspects and advantages of the invention will be better understood from the following detailed description of the invention with reference to the drawings, in which.

DETAILED DESCRIPTION OF THE INVENTION

Figure 1:
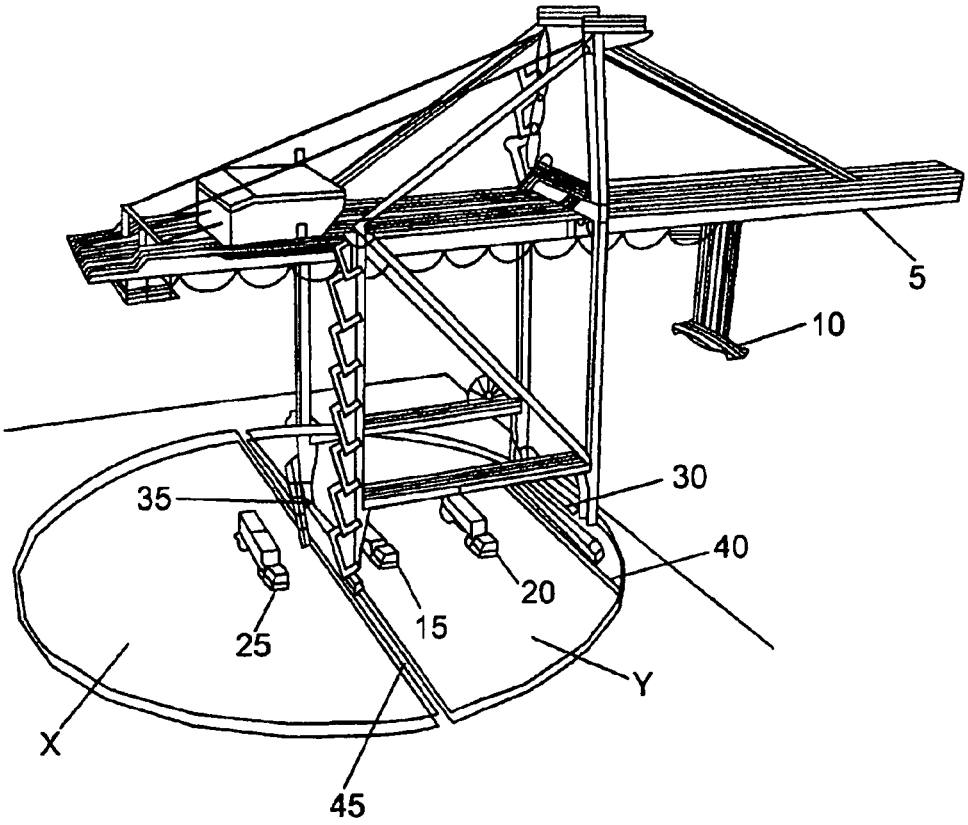
FIG. 1 is a perspective view of a gantry crane.

Referring now to FIG. 1, a partial perspective view of a gantry crane in a dockside arrangement is presented. The crane structure is situated over a series of lanes which can be occupied by loaded and unloaded Bomb Carts and Shuttle Carriers. Crane boom 5 extends away from the waterside frame of the crane. Spreader 10 hangs below boom 5. Unloaded Bomb Cart 15 and loaded Bomb Carts 20 and 25 are located on the ground beneath the crane. Waterside sill beam 30 and landside sill beam 35 (not clearly visible in this figure) connect the vertical crane support elements parallel to the lanes occupied by the loaded and unloaded Bomb Carts. Both of these sills are affixed to stowage beams beneath each vertical support which typically include wheels engaged within a waterside rail 40 and a landside rail 45.

Figure 2:
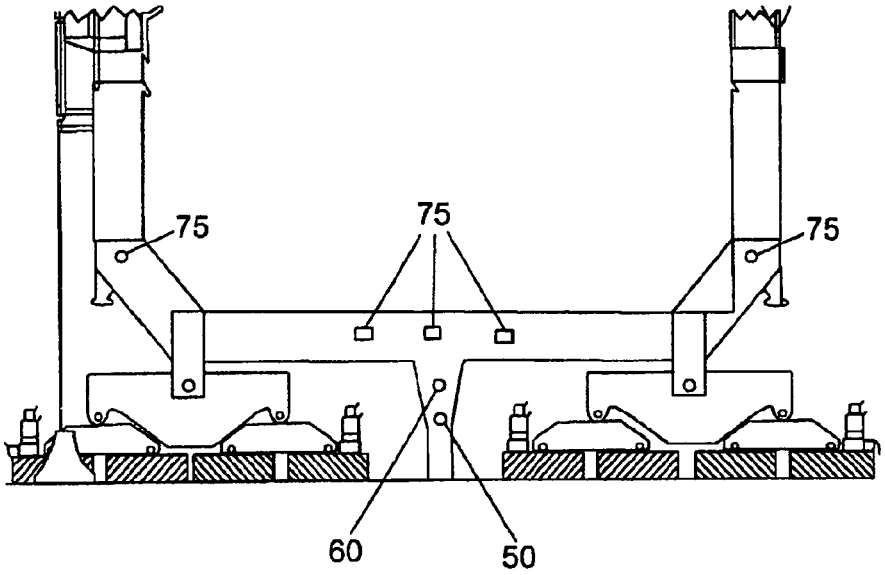
FIG. 2 is a partial plan view of one side of a landside sill beam.
Figure 6:
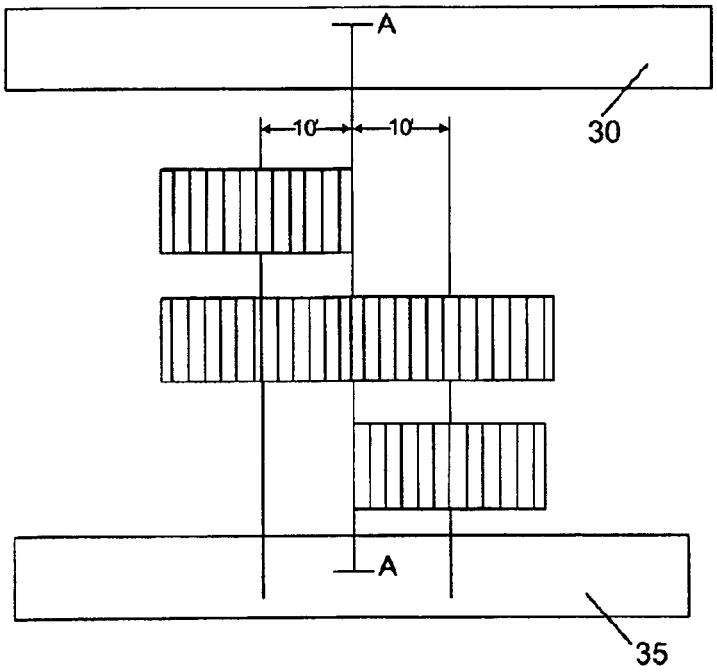
FIG. 6 is a block diagram showing the approximate default stopping positions for various spreader lengths.

FIG. 2 presents a plan view of landside sill beam 35 on the side thereof facing loaded Bomb Cart 25. Four laser scanners 50, 55, 60 and 65 are mounted on landside sill beam 35, two facing landside which are visible in FIG. 2 and two facing waterside which are not visible in FIG. 2. First scanners 50 and 55 are mounted on opposing sides of landside sill beam 35, each at the same height which is approximately one meter above the level of landside rail 40. Second scanners 60 and 65 are also mounted on opposing sides of landside sill beam 35 each at the same height which is approximately three meters above the level of landside rail 40. Horizontally, all of the scanners are located at the approximate center of landside sill beam 35 at points equidistant from the opposing vertical supports at each end of landside sill beam 35 along the approximate crane centerline A-A shown in FIG. 6. The purpose of the different mounting heights of the various scanners is to enable first scanners 50 and 55 to scan the Bomb Cart and Shuttle Carrier vehicles, while second scanners 60 and 65 scan containers which arrive loaded on Bomb Carts and Shuttle Carriers. These scanners provide many discrete distance measurements over the continuous rotational profile of the scanned area. The scanner data collected represents detection and measurement of Bomb Cart, Shuttle Carrier and, container positions relative to the crane. The accuracy and range of laser scanners is typically specified for a dark target at a maximum range. The nominal range of the laser scanners for this application is 40 meters to a dark target, which is more than sufficient to meet the requirements of the application. However, lasers having a range of at least 30 meters are required for this application. All of the lasers have a 180 degree horizontal field of operation parallel to the ground such that the scanned area for scanners 50 and 60 is denoted by semicircle X in FIG. 1 while the scanned area for scanners 55 and 65 is denoted by semicircle Y in FIG. 1. The measurements provide by this system are continuous over the measurement range of each scanner. The apparatus of this invention is capable of providing alignment information for at least a total of six lanes, up to five of which are under the portal beam of the crane, i.e. within semicircle X, and at least one of which is in the backreach area, i.e. within semicircle Y although the system can be configured to handle a larger number of lanes. The data collected by the scanners is transmitted to a computer system running proprietary MAXVIEW® software. MAXVIEW is a registered trademark belonging to TMEIC Corporation of Virginia.

Figure 3:
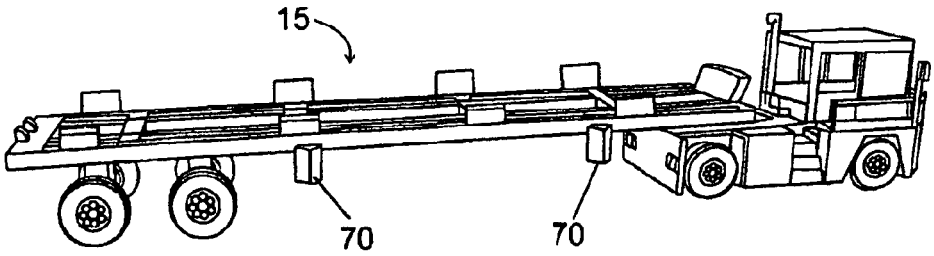
FIG. 3 is a perspective view of a Bomb Cart.
Figure 4:
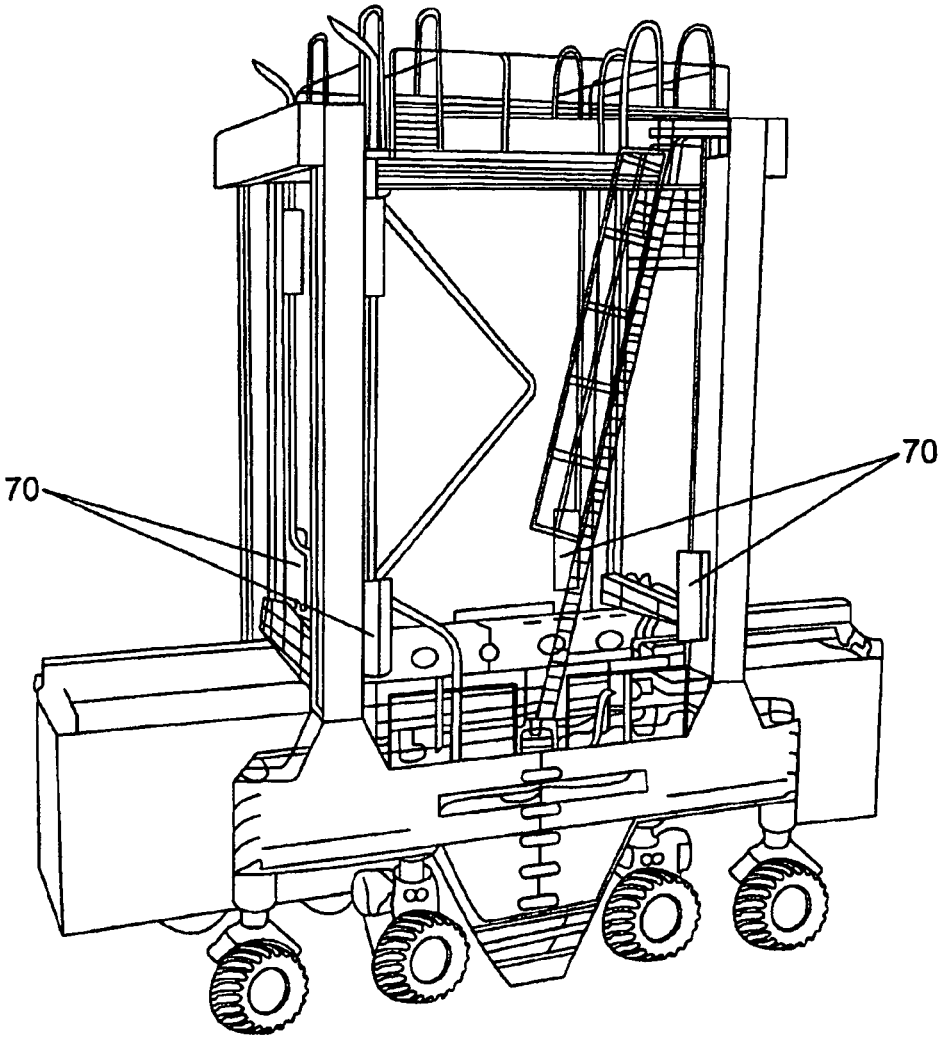
FIG. 4 is a perspective view of a Shuttle Carrier.

At least two (one on each side), but preferably four, passive first targets 70 are mounted on each Bomb Cart and each Shuttle Carrier, two on each side of each such vehicle. Although a triangularly shaped target is typically used, the shape and dimensions of the target are irrelevant so long as data describing the shape and dimensions is provided in advance to the computer system processing the scanning data. In order to maximize target detection and measurement, each passive target is preferably white. These targets act as reference points for detection by the scanners and use by the software in determining position measurements. FIG. 3 illustrates the location of two targets 70 on an empty Bomb Cart. The remaining two targets are not visible but are mounted similarly on the other side of the Bomb Cart opposite the two targets which are visible. FIG. 4 illustrates the location of four targets 70 on a Shuttle Carrier. The mounting positions of the targets on each type of vehicle must be known and must be consistent within the same category of vehicle, i.e. Bomb Cart and Shuttle Carrier, in order to enable the MAXVIEW®, a trademark of TMEIC Corporation, software used with this system to calculate accurate position data. In addition, at least one passive second target 72 is mounted on each side of each container at the approximate longitudinal center of the container and at the same height as scanners 60 and 65 which is about three meters above the height of a landside rail.

Each crane employing the apparatus and method of this invention requires at least the following computer hardware: industrial grade, Pentium-class, PC compatible embedded computer; 100 Bast-T Cat5 Ethernet port for connection to the crane network and DIN-rail mounting. This equipment is mounted in a crane control case within the electrical house of the crane. The computer is pre-configured with Microsoft Windows embedded OS, MAXVIEW® Platform Support Software and the MAXVIEW® Application. Maxview® is the real-time scan processing engine for all MAXVIEW® functions. It also includes system setup and troubleshooting features. The proprietary Maxview® software receives the discrete scan point measurements provided by the laser scanners, detects the edges of key objects within the laser scans, and reports measurements of these edge positions in various coordinate systems to the MAXSPEED® Crane Control System. MAXSPEED® is a trademark owned by TMEIC Corporation. For this application, the interface between the MAXVIEW® and MAXSPEED® systems and software is via Ethernet Global Data (EGD). Interface equipment and power supplies are also necessary for the scanners and computer system.

Figure 5:
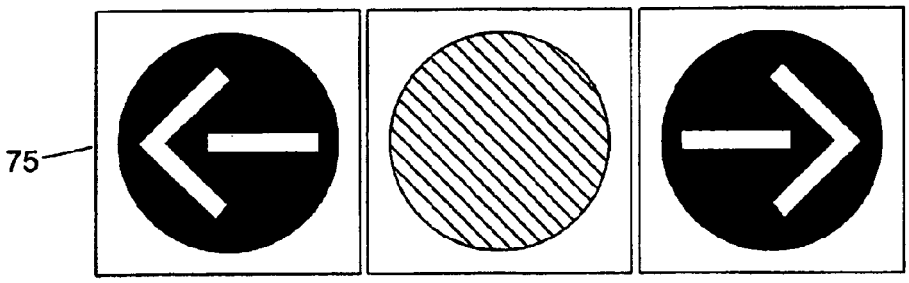
FIG. 5 is a plan view of a position indicator device.

In addition, each crane employing the system and method of this invention is equipped with at least one position indicator device 75 mounted on the crane at a location from which it is visible to the driver of either a Bomb Cart or a Shuttle Carrier when the driver is in the vicinity of the proper location to enable loading or unloading of a container from that vehicle. For example, the devices could be mounted on either or both sides of landside sill beam 35 and/or on the landside of waterside sill beam 30 near the bottom of each crane leg. Preferably, there are at least four devices 75 mounted on landside sill beam 35, two on each side thereof at each crane leg and two devices 75 mounted on waterside sill beam 30 on the interior side thereof at each crane leg. The exact positioning of the devices can be adjusted to accommodate vehicles having differing dimensions and varying driver positions. In one configuration shown in FIG. 2, two devices 75 are mounted higher on the vertical legs of the crane, while three more devices 75 are mounted on one side of landside sill beam 35 grouped towards the center of that sill beam. This arrangement accommodates both the Shuttle Carrier driver who sits high and has a 360 degree view around the vehicle (and therefore can see the three centralized devices 75) and the Bomb Cart driver whose unrestricted view is best immediately to the side of the truck cab (and therefore can best see the two devices 75 mounted on the vertical columns of the crane. An example of such a device 75 itself is shown in FIG. 5. In this example, there are three areas capable of being activated or illuminated by backlighting, LED bulbs or otherwise. When the first area is activated, it signals the driver to move the vehicle backwards. When the second area is activated, it signals the driver to stop since the vehicle is in the proper position. Finally, when the third area is activated, it signals the driver to move the vehicle forward. Indicator 75 may also be used to indicate to a driver by color, sound, flashing or otherwise that the vehicle is skewed in excess of a predetermined, known maximum acceptable skew angle. For the purpose of this disclosure it is assumed that the skew of any container loaded or locked on the vehicle is equivalent to the skew of the vehicle itself. This is an appropriate assumption for the normal types of container handling equipment in these terminals Any or all of colors, flashing, different or varying duration illumination periods, sounds and various movement indicators other than arrows may be used in device 75.

After the system hardware has been installed as described above, the system process is as follows:

1. All of the laser scanners are activated so as to emit laser beams within semicircles X and Y.

2. A driver selects a lane either in the portal area or in the backreach area into which to drive a vehicle.

3. In the event an unloaded Bomb Cart or Shuttle Carrier is being driven, second laser scanners 60 and 65 will register no target return signal while first laser scanners 50 or 55, depending on whether the vehicle is in the portal or backreach area, will detect targets on the vehicle, so that the computer to which the scanners are connected concludes that the arriving vehicle is an unloaded one.

4. As the unloaded vehicle progresses along the chosen lane, repetitive emissions from the at least one second laser scanner produce reflective data enabling the computer to determine the following:

a. the lane in which the vehicle is travelling as indicated by the distance of the vehicle from the waterside sill beam;

b. the position offset of the vehicle from the crane centerline A-A in the direction of truck travel; and c. the skew angle, if any, formed between the longitudinal centerline of the vehicle and a line parallel to the longitudinal centerline of waterside sill beam 30 or landside sill beam 35, whichever is closest to the vehicle.

5. In the event a Bomb Cart or Shuttle Carrier loaded with a container is being driven, at least one first laser scanner 50 or 55 and at least one second laser scanner 60 or 65, depending on whether the vehicle is in the portal or backreach area, will detect targets on the vehicle and on the container(s), so that the computer to which the scanners are connected concludes that the arriving vehicle is a loaded one.

6. As a loaded vehicle progresses along the chosen lane, repetitive emissions from the at least one first laser scanner produce reflective data enabling the computer to determine the following:

a. the lane in which the vehicle is travelling as indicated by the distance of the vehicle from the waterside sill beam;

a. length of the container(s) on the vehicle: 20 feet, 40 feet, 45 feet or Twin-20 foot;

b. the position offset of the container(s) from the crane centerline A-A in the direction of truck travel;

c. the position of the container(s) from the waterside sill beam (i.e., the truck lane);

d. the skew angle, if any, formed between the longitudinal centerline of the container(s) and a line parallel to the longitudinal centerline waterside sill beam 30 or landside sill beam 35; and e. in the case of twin-20 foot containers: the gap distance between the two containers on the vehicle.

All of the measurements listed above are provided regardless of the driving direction of the vehicle. The position data provided by the system is accurate to approximately +/−50 mm (2 inches), while the skew angle data is accurate to approximately 0.4 degrees.

Based on the known length of spreader 10 attached to the crane's trolley, the computer applies the following rules in activating indicator device 75 to provide positioning information to the vehicle driver:

1. For an unloaded Bomb Cart or a loaded or unloaded Shuttle Carrier:

a. If the spreader length is 40 feet, 45 feet, or Twin-20 feet: Match the center of the Bomb Cart or Shuttle Carrier with the crane centerline A-A; and b. If the spreader length is 20 feet: Match the center of the Bomb Cart or Shuttle Carrier with a point 10 feet plus a known fixed offset forward or reverse relative to crane centerline A-A. The forward/reverse selection depends on load condition of the Bomb Cart (i.e., whether there is a single 20 foot container already on the front or rear half of the vehicle) and spreader load condition (whether the spreader is locked on a container or unlocked with no container attached thereto).

2. For a loaded Bomb Cart:

a. If the spreader length is 40 feet, 45 feet, or Twin-20 feet: Match the center of Containers on the Bomb Cart with the crane centerline A-A; and b. If the spreader length is 20 feet: Match the center of one of the 20 foot containers with the crane centerline A-A. The forward/reverse container selection depends on load condition of the Bomb Cart (i.e., whether there is a single 20 foot container already on the front or rear half of the vehicle) and spreader load condition (locked or unlocked). The default approximate stopping positions for a driver are shown in an overhead block diagram form in FIG. 6.

3. For any loaded or unloaded Bomb Cart or Shuttle Carrier:

a. If scanning data reveals a measured skew angle beyond a known, predetermined limit, activate position indicator device 75 to signal to the driver through flashing, sound emission, color change, signal sequencing or other method that this condition exists. The crane operation is terminated until the vehicle is repositioned such that skew angle is adjusted to be less than or equal to the known, predetermined limit.

For example, a Bomb Cart can carry up to two 20 foot containers with one 20 foot container located forward on the bomb cart, and the other towards the rear. When the crane is configured to handle 20 foot containers, the Bomb Cart must be aligned such that the crane can pick up (or land) each container individually. If the spreader is unlocked (meaning that it is configured to pick up a container from the Bomb Cart) and set for 20 feet and if two 20 foot containers are detected on the Bomb Cart, then the system guides the driver in aligning the Bomb Cart such that the forward container is aligned with the crane spreader. If the spreader is unlocked and set for 20 feet, and if a single 20 foot container is detected on the Bomb Cart, then the system guides the driver in aligning the Bomb Cart with that container, regardless of its position on the Bomb Cart. If the spreader is locked and set for 20 feet, and if no containers are detected on the Bomb Cart, then the system guides the driver in aligning the Bomb Cart such that the 20 foot container on the spreader will be landed on the forward area of the Bomb Cart. If the spreader is locked and set for 20 feet and if a single container is detected on the Bomb Bart, then the Bomb Cart is aligned such that the 20 foot container on the spreader will be landed on the opposite free area of the Bomb Cart (forward/rear).

The apparatus of the system disclosed above works under all weather conditions expected in the port environment. In addition, it is customizable and flexible to match the needs of the operation and provide the most efficient use of equipment already installed.

The arrangement of the system described above is able to provide positioning information for a maximum of two vehicles: the first one located underneath the crane between waterside sill beam 30 and landside sill beam 35 and the second one located in the backreach area beyond the exterior side of landside sill beam 30. In an alternative arrangement, additional scanners 80 and 85 can be placed on the interior side of waterside sill beam 30, positioned with respect to each other similarly to scanners 50, 55, 60 and 65, together with additional position indicator devices 75, positioned as on landside sill beam 35. This arrangement enables the system to provide positioning information for two vehicles occupying two lanes under the gantry crane.

The foregoing invention has been described in terms of a preferred embodiment. It will be apparent to those skilled in the art that various modifications and variations can be made to the disclosed apparatus and method without departing from the scope or spirit of the invention and that legal equivalents may be substituted for the specifically disclosed elements of the invention. The specification and examples are exemplary only, while the true scope of the invention is defined by the following claims.

What is claimed is:

1. A system for assisting drivers of Bomb Cart and Shuttle Carrier vehicles in properly positioning their vehicle types, which are either unloaded or loaded with one or more containers beneath a gantry crane having a landside sill beam mounted on a landside rail and a waterside sill beam mounted on a waterside rail, each sill beam having an interior side facing the interior side of the opposing sill beam and an exterior side facing away from the opposing sill beam, the acceptable position being one in which the center of the side of the vehicle closest to either sill beam is less than a predetermined, known distance away from the center line of the crane represented by a line drawn from the center of the waterside sill beam through the center of the landside sill beam and the vehicle is skewed less than a predetermined, known amount, skew being the angle, if any, formed between a line drawn parallel to either sill beam and a line drawn parallel to the longitudinal centerline of the vehicle, comprising:

at least one first laser scanner means attached both to the exterior and interior sides of the landside sill beam for detecting the presence, location and orientation of any loaded or unloaded vehicle entering within the range of said first laser scanner means;

first target means each having a known shape and dimensions and at least one of which is attached to each side of each vehicle for reflecting emissions from said at least one first laser scanner means;

at least one second laser scanner means attached to both the exterior and interior sides of the landside beam for detecting the presence, location and orientation of any container loaded on a vehicle entering within the range of said second laser scanner means;

second target means each having a known shape and dimensions and at least one of which is attached to each side of each container for reflecting emissions from said at least one second laser scanner means;

at least one direction indicator means attached to each of the exterior side and the interior side of the landside sill beam for indicating to vehicle drivers whether their vehicle is properly positioned or needs to be moved forward or backward and whether their vehicle orientation is skewed in excess of a predetermined acceptable amount and needs to be repositioned; and computer means connected to the crane, to each of said at least one first laser scanner means and said at least one second laser scanner means and to each of said at least one direction indicator means for receiving scanning data from said first laser scanner means and said second laser scanner means in order to calculate the location and orientation of any vehicle within the range of said first laser scanner means and the location and orientation of any container loaded on a vehicle within the range of said second laser scanner means and, further, for activating said direction indicator means.

2. The system of claim 1 wherein one of said at least one first laser scanner means is mounted at the approximate longitudinal center of each side of the landside sill beam at a height of approximately one meter above the landside rail.

3. The system of claim 2 wherein two of said first target means are attached to each side of each type of vehicle at positions which are a known, predetermined horizontal distance displaced from both ends of each type of vehicle and at the same approximate height as each of said first laser scanner means.

4. The system of claim 1 wherein one of said second laser scanner means is mounted at the approximate longitudinal center of each side of the landside sill beam at a height of approximately three meters above the landside rail.

5. The system of claim 4 wherein at least one of said second target means is attached to each side of each container, each of which is located at a position which is a known, predetermined horizontal distance displaced from both ends of the container and at the same approximate height as each of said second laser scanner means.

6. The system of claim 1 wherein at least two direction indicator means are mounted on each of the interior side and the exterior side of the landside sill beam near the bottom of each crane leg at a known, predetermined height visible to the driver of each vehicle type.

7. The system of claim 6 wherein further at least one direction indicator means is mounted on the interior side of the waterside sill beam near the bottom of at least one of the two crane legs.

8. The system of claim 1 wherein each of said at least one first target means and said at least one second target means are triangularly shaped and white-colored.

9. The system of claim 1 wherein at least one of said first laser scanner means and at least one of said second laser scanner means are attached to the interior side of the waterside sill beam, the at least one first laser scanner means being attached at the approximate longitudinal center of the interior side of the waterside sill beam at a height of approximately one meter above the waterside rail and the at least one second laser scanner means being attached at the approximate longitudinal center of the interior said of the landside sill beam at a height of approximately one meter above the waterside rail.

10. A method for assisting drivers of Bomb Cart and Shuttle Carrier vehicles in properly positioning their vehicle types in one of several lanes located in the portal area and backreach area beneath a gantry crane, the vehicles arriving either unloaded or loaded with one or more containers, for further loading or unloading of containers beneath the crane, the crane having a known crane centerline, a landside sill beam mounted on a landside rail and a waterside sill beam mounted on a waterside rail, each sill beam having an interior side facing the interior side of the opposing sill beam and an exterior side facing away from the opposing sill beam, at least one first laser scanner being attached to both the exterior and interior sides of the landside sill beam approximately at the longitudinal center thereof about one meter above the landside rail and at least one second laser scanner being attached to both the exterior and interior sides of the landside sill beam approximately at the longitudinal center thereof about three meters above the landside rail, at least one direction indicator being attached to each of the interior side and the exterior side of the landside sill beam at a height viewable by the driver of either a Bomb Cart of Shuttle Carrier vehicle, each vehicle having attached thereto at a known position on the vehicle at least one first target on each side thereof at a height of approximately one meter above the landside rail and each container having attached thereto at a known position at least one second target on each side thereof at a height of approximately three meters above the landside rail, a computer being associated with the crane and further being connected to each of the first and second laser scanners and each direction indicator device, wherein the shape and dimension of each target, the crane spreader length and an acceptable maximum skew angle for each type of vehicle and each container are known, comprising:

activating each of the at least one first and at least one second laser scanners;

a driver selecting and driving a Bomb Cart or Shuttle Carrier vehicle into a lane beneath the crane;

sending emission return data from each of the at least one first and at least one second laser scanners to the computer;

if there is no emission return data detecting a second target from the at least one first laser scanner, transmitting emission return data from each of the at least one second laser scanner to the computer until at least one target is detected and thereafter:

calculating the distance to the first target;

comparing that distance to the known distance between the first laser scanner and the interior side of the waterside sill beam;

determining the lane in which the vehicle is travelling;

calculating further the position offset of the vehicle from the crane centerline based on the position of each first target on the vehicle as compared with the crane centerline;

calculating yet further the skew angle of the vehicle;

if there is emission return data detecting a second target from the at least one second laser scanner, transmitting emission return data from each of the at least one first laser scanner and each of the at least one second laser scanner to the computer and thereafter:

calculating the distance to the first target;

comparing that distance to the known distance between the first laser scanner and the interior side of the waterside sill beam;

determining the lane in which the vehicle is travelling;

determining the length of each container loaded on the vehicle based on the number and position of the second targets detected through emission return data;

further determining the number of containers loaded on the vehicle;

if there are two containers loaded on the vehicle, calculating the gap distance between the two containers based on their length and their positions;

determining the position offset of each container from the crane centerline with regard to the direction of travel of the vehicle;

determining the distance of each container from the waterside sill beam;

calculating yet further the skew angle of the vehicle;

if the vehicle is an unloaded Bomb Cart or a loaded or unloaded Shuttle Carrier, and if the crane spreader length is 40 feet, 45 feet or Twin-20 feet, controlling each direction indicator so as to direct the driver to position the center of the vehicle in approximate alignment with the crane centerline and within the acceptable skew angle; or if the crane spreader length is 20 feet, controlling each direction indicator so as to direct the driver to position the center of the vehicle at a point 10 feet plus or minus a known fixed offset from the crane centerline and within the acceptable skew angle;

if the vehicle is a loaded Bomb Cart, and if the crane spreader is 40 feet, 45 feet or Twin-20 feet, controlling each direction indicator so as to direct the driver to position the vehicle such that the center of the vehicle is in approximate alignment with the crane centerline and within the acceptable skew angle; or if the crane spreader length is 20 feet, controlling each direction indicator so as to direct the driver to position the vehicle such that the center of one of the 20 foot containers is approximately aligned with the crane centerline and within the acceptable skew angle.

* * * * *